US005372291A

United States Patent [19]

Vogeli et al.

[11] Patent Number: 5,372,291

[45] Date of Patent: Dec. 13, 1994

[54] BASE ASSEMBLY FOR AUTOMATIC RIVETING MACHINE

[75] Inventors: Peter R. Vogeli; Peter B. Zieve, both of Seattle, Wash.

[73] Assignee: Electroimpact, Inc., Mukilteo, Wash.

[21] Appl. No.: 954,536

[22] Filed: Sep. 29, 1992

[51] Int. Cl.[5] ..... B21J 15/30

[52] U.S. Cl. ..... 227/1; 227/6

[58] Field of Search ..... 227/5, 6, 53, 111, 1; 83/13

[56] References Cited

U.S. PATENT DOCUMENTS

| | | | |
|---|---|---|---|
| 4,605,149 | 8/1986 | Farrens et al. | 227/111 X |
| 4,651,601 | 3/1987 | Sasaki | 83/13 |
| 4,811,640 | 3/1989 | Fritsch | 83/13 X |
| 5,037,020 | 8/1991 | Sell | 227/111 X |
| 5,090,282 | 2/1992 | Ruesch | 83/13 |
| 5,216,959 | 6/1993 | Hayashi | 83/13 |

*Primary Examiner*—Rinaldi I. Rada
*Attorney, Agent, or Firm*—Jensen & Puntigam

[57] ABSTRACT

A base assembly for use with a riveting apparatus such as an electromagnetic riveter (EMR). In one aspect of the invention, the base assembly includes a base plate (42) having a raised beveled portion (80) extending upwardly from the upper surface (54) of the base plate (42). A mounting plate (72) fits on and is secured to the base plate (42) by a plurality of coil springs (90–93). The mounting plate (72) has a recessed portion (66) in the lower surface thereof which mates with the raised portion (80) of the base plate (42). Trip switches (104–107) are positioned in the mounting plate (72) for detection of movement of the mounting plate (72) relative to the base plate (42) in response to undesired contact between the EMR and a part assembly or fixture therefor. An output signal indication is provided when one or more of the trip switches (104–107) are actuated. In another aspect of the invention, a base assembly mounting plate (152) is mounted on mounting studs (168–171) and locating pins (156, 158) which extend upwardly from a base member (154). An EMR is mounted on the mounting plate (152). Spring washers 180–183 are located between the mounting plate (152) and the base member (154). The washers are configured to permit a selected amount of preload compression by locking nuts operating on the mounting studs while still permitting a selected range of movement for height adjustment by turning the locking nuts in one direction.

11 Claims, 7 Drawing Sheets

BASE ASSEMBLY FOR AUTOMATIC RIVETING MACHINE

TECHNICAL FIELD

This invention relates generally to automatic riveting machines and more specifically concerns a base assembly for use with such riveting machines.

BACKGROUND OF THE INVENTION

In many riveting applications using conventional, two-ended solid rivets, such as those used in aircraft assembly applications, one end of the rivet, which is inserted through two adjoining parts, is obscured from view by the configuration of one of the parts being assembled. For instance, in the assembly of an aircraft wing, involving the attachment of longitudinal stiffeners to a section of wing skin, one of the opposing riveting head assemblies, which includes a pressure foot and an anvil (ram), will move along the stiffener quite close to the leg portion thereof. The stiffener leg portion may take various configurations, including the particular "J" stringer configuration shown in FIG. 1.

Since, as illustrated in FIG. 1, the tolerance for movement of the riveting head assembly relative to the stringer is quite limited, except in the longitudinal direction, sometimes there will occur significant contact between the riveting head and the part assembly, i.e. the stringer, due to incorrect movement or erroneous initial positioning of the riveting head. This contact typically causes substantial damage to the assembly part as well as the riveting machine, resulting in significant loss in manufacturing time and considerable expense. Such contact and resulting damage is referred to generally as a "crash". Crashes, of course, are to be avoided if at all possible; they do, unfortunately, occur with regularity. This problem occurs for both the conventional hydraulic riveting machines, in which opposing riveting machine head assemblies are carried on a large "C" shaped yoke shown in FIG. 1, as well as for the newer electromagnetic riveting machines having separate, opposed riveting heads which are typically carried on a much lighter yoke, such as shown in U.S. Pat. No. 4,862,043 to Peter Zieve. The problem occurs most frequently in those riveting applications where one of the riveting heads is obscured from the view of the operator because of the configuration of one or more of the assembly parts, such as where one or more of the parts has a protruding and hooked configuration, like the combination of a wing panel and J stringer in FIG. 1.

Even relatively small errors in movement of the riveting heads during operation of the apparatus or in one or more of the several moves necessary to properly initially position the riveting heads will result in a crash in a confined operating situation. There have been attempts, however, to solve this significant problem. One such attempt includes the use of a riveting head pressure foot which releases during a crash. The pressure foot is held in position with a spring detent arrangement, and when a crash occurs the pressure foot assembly in effect breaks away and falls from the riveting head. The disadvantage of such an arrangement is that the operator must manually reinstall the pressure foot on the riveting head assembly after each such crash. This is time consuming and is often difficult since the riveting heads are frequently some distance off the ground. Hence, there is a significant need in many riveting applications to minimize and/or prevent damage which is caused by inadvertent contact between the riveting apparatus and the part assembly during riveting operations.

Another significant problem in many riveting applications involves the precise alignment of the two opposed riveting head assemblies on the rivet. It is important that each riveting head be aligned on the rivet to a relatively high tolerance, typically 0.002" or so, in order to ensure high quality rivet formation. The alignment of the riveting heads occurs in two directions, sideways, i.e. lengthwise along the part assembly and heightwise, i.e. vertically.

Typically, there is no difficulty aligning the one rivet head assembly which is on the same side of the panel as the drill unit, since accurate alignment of that assembly is achieved by simply moving the riveting head lengthwise the center distance between the riveting head and the drill. The riveting head on the drill side thus is centered on the rivet opening and thus centered on the rivet when the rivet is inserted therein.

For the opposing riveting head, the longitudinal alignment is typically accomplished by a conventional high resolution slide, such as a dovetail arrangement. However, the height of the riveting head is more difficult to control. In the past, shims have been used to set the desired height. However, this requires that the riveting head be first released from its mounting structure, the shims installed and then the riveting head remounted. This takes time and often is not very precise. Multiple shim insertions are usually required. Such a procedure cannot be accomplished during actual operation of the riveter.

Hence, there is a significant need for a height adjustment system for a riveting head assembly which is convenient and accurate and which can be used by the operator of the riveting apparatus. It would also be desirable to be able to accomplish the height adjustment during riveting operations.

Summary of the Invention

Accordingly, one aspect of the invention is a base assembly for use with a tool apparatus which performs multiple high force operations on a part assembly, wherein the tool apparatus includes a positioning assembly to which the base assembly is secured, the base assembly comprising: a base member which moves with the positioning assembly along the part assembly during operation of the tool apparatus, wherein the base member has a first mating surface portion; a mounting member which has a second mating surface portion which conformably mates with the first mating surface portion of the base member such that the mounting member is accurately located relative to the base member, wherein the mounting member is adapted for a rigid mounting of the tool apparatus thereon, so that the tool apparatus is precisely located relative to the base member; resilient member means holding the mounting member to the base member; and sensor means positioned such that when contact occurs between the tool apparatus and an object, the position of the mounting member relative to the base member changes, the sensor means producing an indication thereof.

Another aspect of the present invention is a base assembly for height adjustment of a tool apparatus which performs high force operations, relative to a surface element, comprising: a mounting member adapted for a rigid mounting of a tool apparatus; connecting means, including resilient, compressible elements, extending between the surface element and the mounting member, the resilient compressible elements being positioned between the surface element and the mounting member; and means cooperating with the connecting means for pressing the mounting member toward the surface element, compressing the compressible elements with a selected preload, wherein adjustment of the cooperating means results in a change in height of the tool. apparatus relative to the surface element.

BEST MODE FOR CARRYING OUT THE INVENTION

Figure 1:
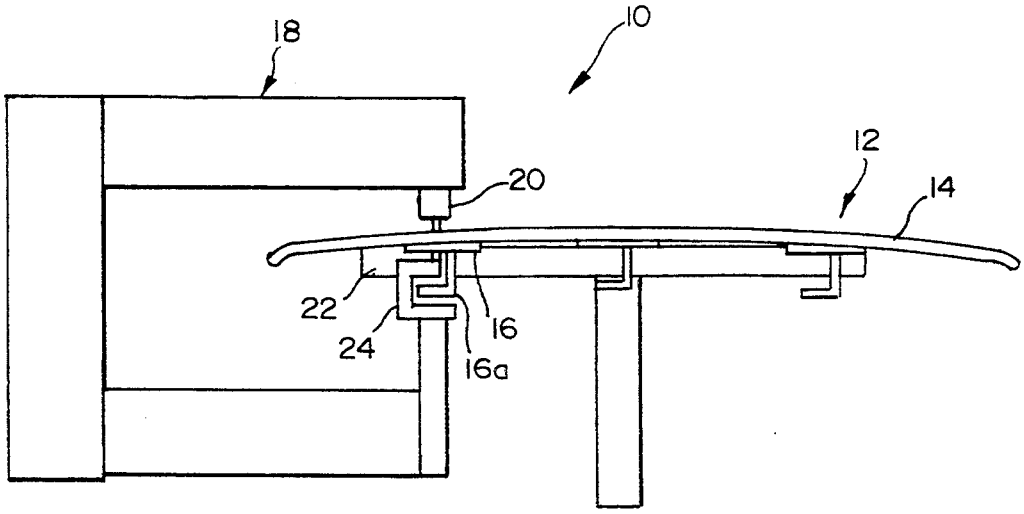
FIG. 1 PRIOR ART
FIG. 1 is a side elevational view of a conventional "C" yoke riveting apparatus operating on a wing panel/"J" stringer part assembly.

FIG. 1 shows an automatic riveting apparatus, generally at 10, for performing riveting operations along a part assembly 12 which comprises a wing panel 14 and a "J" stringer 16. In aircraft wing assembly operations, other stringer configurations, including "H" shaped, "L" shaped and "hat" shaped, can be used. The riveting apparatus 10 includes a "C" shaped yoke 18 with opposing riveting head assemblies 20 and 22. The riveting assemblies 20 and 22, each include a ram element and pressure feet for contact with the part assembly.

Figure 2:
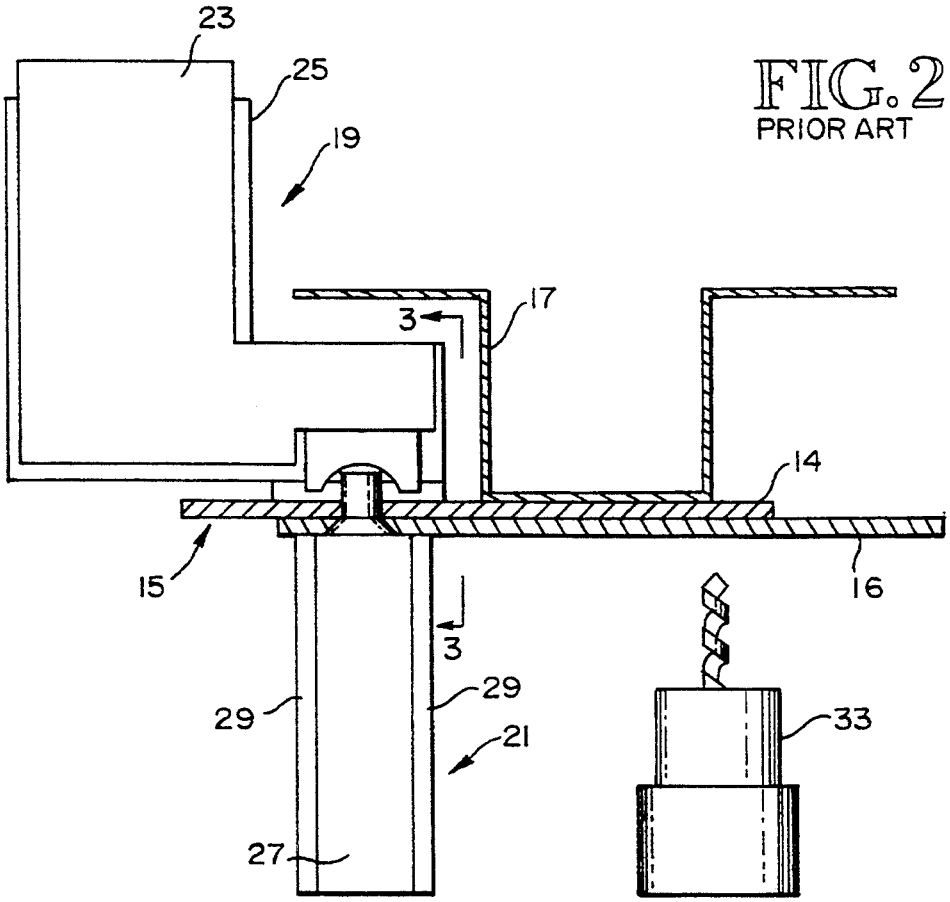
FIG. 2 PRIOR ART
FIG. 2 is a side elevational view showing in more detail a relationship of pressure feet and upset rams on opposite sides of a part assembly for a riveting apparatus.
Figure 3:
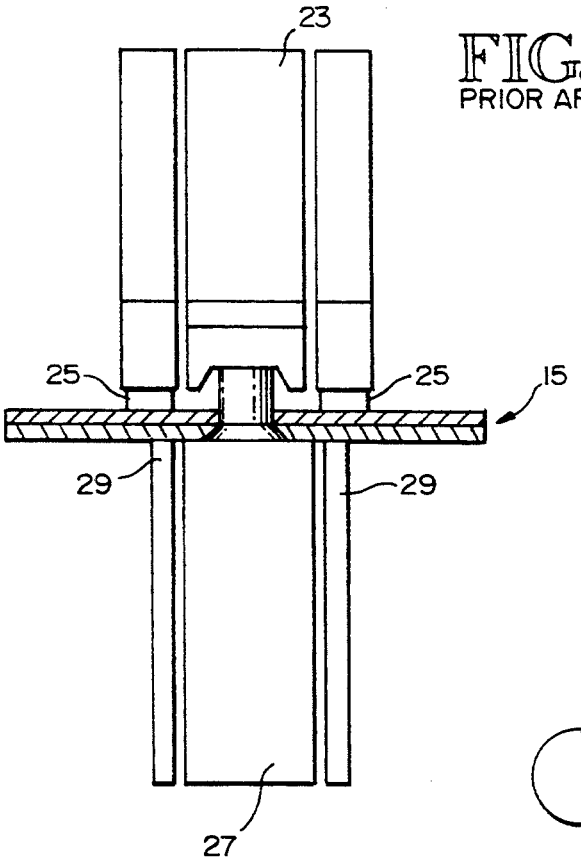
FIG. 3 PRIOR ART
FIG. 3 is a cross-sectional view taken along lines 3—3 of FIG. 2.

FIGS. 2 and 3 show an opposed riveting head assembly system for operating on an aircraft fuselage assembly 15, using a hat stiffener element 17. This arrangement includes two opposed riveting assemblies 19 and 21, and a drill assembly 33 associated with riveting assembly 21. Riveting head assembly 19 includes a ram 23 and pressure feet elements 25—25 while riveting head assembly 21 includes a ram 27 and pressure feet elements 29—29. Other specific applications and particular arrangements are, of course, possible which have the same problems of tight clearance and offset tooling.

Typically, referring to FIG. 1, riveting head assembly 20, which is on the skin panel side of wing panel 14, will be in full view of the operator and need not be offset or angled. However, riveting head assembly 22 must move adjacent stringer 16 within a rather confined space and therefore will typically include an offset anvil portion 24.

In operation part assembly 12 is first clamped together, with the pressure feet of each riveting head assembly pressing toward each other from opposing sides, typically in the range of 300–2000 pounds. The pressure feet have apertures therethrough through which the riveting elements are moved. Initially, a hole is drilled through the part assembly by a drill unit (not shown in FIG. 1). The riveting head assemblies are then moved into position relative to the opening. A rivet is inserted and then upset when the riveting apparatus fires.

As the riveting apparatus moves along the stiffening member (stringer) 16, the pressure foot and the ram of the stringer side riveting head assembly 22 will pass quite close to the stringer leg 16*a*. Travel of the head assembly 22 is limited by the clearance relative to the flange and web portions of the stringer leg. As discussed above, only a small error in the initial positioning of, or in the subsequent operational movement of, the head assembly 22 will cause significant contact between the stringer side head assembly, i.e. the pressure foot or anvil portions thereof, and the part assembly or the fixture in which the part assembly is supported, resulting in damage to the part assembly and/or the fixture and the riveting apparatus.

This is true for conventional "C" yoke hydraulic riveting machines, conventional pneumatic riveting systems and for electromagnetic riveting machines, even though the structural configurations of the systems are quite different. In the "C" yoke hydraulic riveting machine, the typical force required to upset a rivet is within the range of 6,000 pounds to 50,000 pounds, depending upon the size of the rivet. Such "C" yoke structures thus must be quite strong in order to carry these rather large forces around the aircraft assembly or other part assembly with the required minimal amount of deflection. In the alternative electromagnetic riveting system, however, the force on the positioning structure is only approximately 200 pounds, even though the rivet upset force is still 6,000–50,000 pounds. An electromagnetic riveter will usually include a recoilless design, and hence, the recoil effect of an EMR is relatively small. Electromagnetic riveters will typically use light "C" yokes and/or dual opposing independent carriages. Such an electromagnetic riveting apparatus is disclosed in U.S. Pat. No. 4,862,043 to Peter Zieve.

Figure 4:
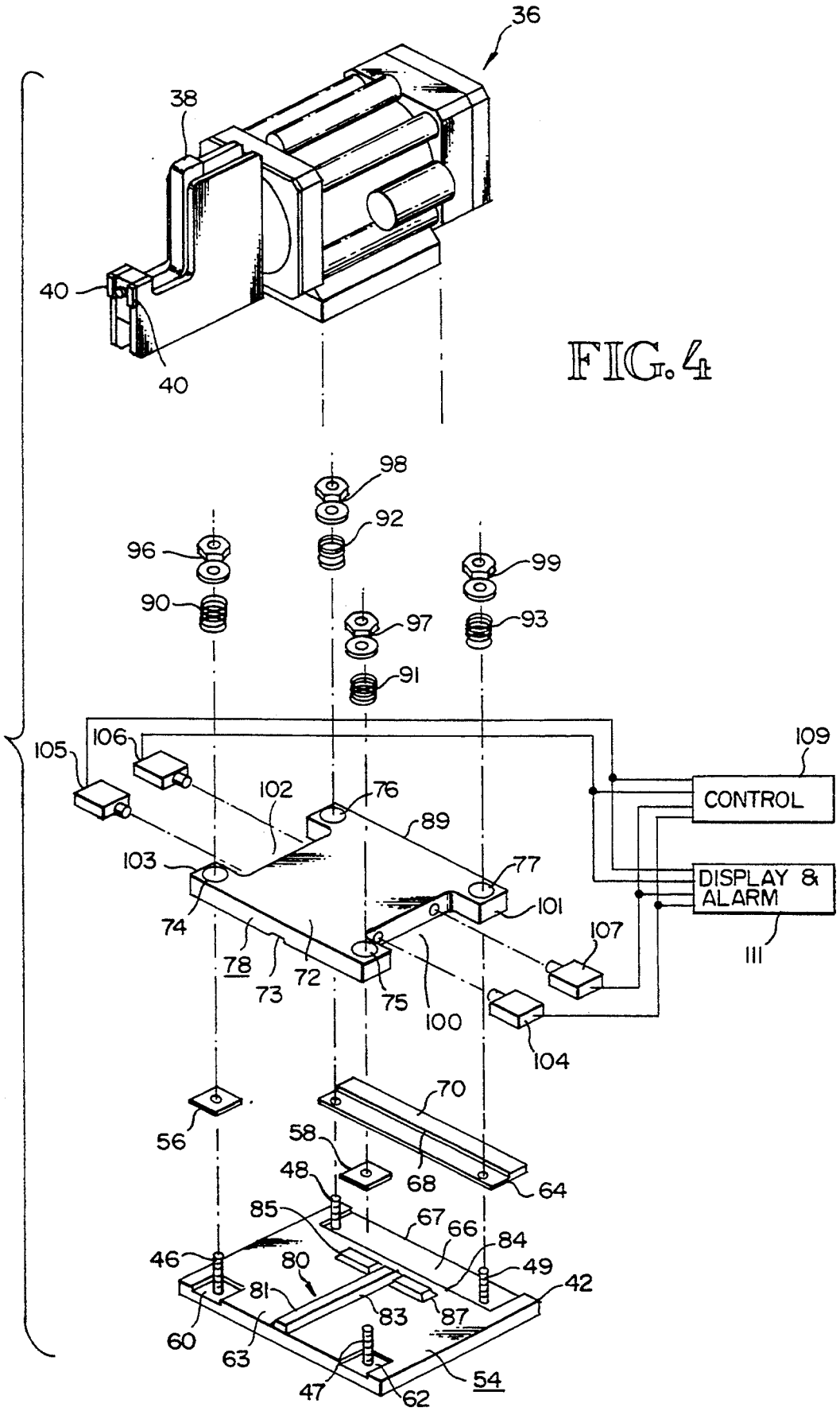
FIG. 4 is an exploded view showing the contact assembly of the present invention which is useful in preventing damage upon a crash contact between the riveting apparatus and the part assembly.

Referring now to FIG. 4, an exploded view of the present invention is shown relative to an electromagnetic riveting tool, shown generally at 36, wherein the electromagnetic riveting tool 36 includes a ram portion 38 and pressure foot arms 40. The electromagnetic riveting tool 36 is shown as an example only. Other riveting tools or other high force tools could be used. The system of FIG. 4 includes a base plate member 42 which forms part of or is attached to a positioning member portion of the automatic riveting apparatus, which in turn is controlled by motors, etc. to move the riveting apparatus along the part assembly. In the embodiment shown, base plate member 42 is approximately square or slightly rectangular, with upstanding spring retainer studs 46, 47, 48 and 49 extending upwardly from the upper surface 54 thereof approximately at each corner thereof.

Small, square contact plates 56 and 58 fit over studs 46 and 47, into small mating recesses 60 and 62 in the upper surface 54 of base plate member 42 at front edge 63 thereof. Plates 56 and 58 are flat and relatively thin. A rear stop element 64 extends between the other two spring retainer studs 48, 49, and fits into a mating recess 66 in the upper surface 54 of the base plate member 42 along rear edge 67 thereof. Rear stop 64 is rectangular and includes a first portion 68 which extends lengthwise of the stop and is approximately ¼ inch thick and a second portion 70 to the rear of first portion 68 which is approximately ½ inch thick. The rear stop 64 thus has a small step between portions 68 and 70 approximately mid-width of stop 64.

Figure 9:
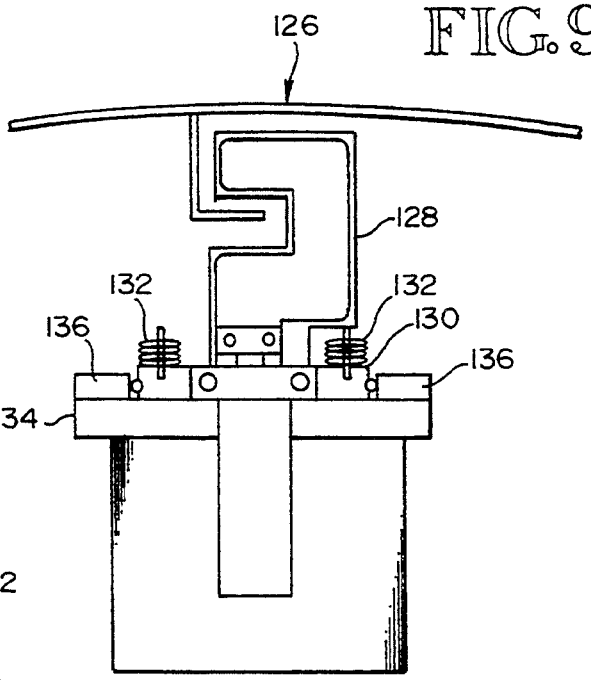
FIG. 9 is a alternative embodiment to that of FIG. 1 useful for large force "C" yoke hydraulic riveting machines.

A mounting plate 72 fits over base plate member 42, with mounting studs 46–49 extending through openings 74 through 77 at each corner in base plate 42. In the lower surface 78 of mounting plate 72 is a recessed portion 73 which mates with, i.e. conforms to the configuration of, a raised portion 80 on the upper surface of base plate member 42. These two portions could be reversed between the base member 42 and mounting plate 72. The raised portion 80 in the embodiment shown is beveled around the periphery thereof between surface 54 and flat top surface 81. The raised portion 80 extends from the front edge 63 of base member 42 to near the inboard edge 84 of recess 66 for rear stop 64. The periphery of raised portion 80 bevels inwardly from surface 54 for a vertical distance of approximately ⅜ inch to top surface 81, which is flat. The bevel angle is within the range of 30°–75°, and is approximately 45° in the embodiment shown. In certain applications, a greater angle could be used, even up to 90°, although at the higher angles, a different effect occurs; the mounting plate and the EMR "lift off" the base plate upon contact, rather than sliding off by virtue of the beveled portion. Such an arrangement is shown in FIG. 9.

Raised portion 80 includes in the embodiment shown a center leg 83 and two perpendicular legs 85, 87 near recess 66, forming a "T" shape. Other configurations are of course possible, depending on the desired sensitivity of the system and the axial directions in which the system is to be operative. The recess in the lower surface of mounting plate 72 is configured to exactly mate with (conform to the configuration of) raised portion 80 on the upper surface of base plate 42, such that mounting plate 72 can fit tightly against base plate 42, with the mounting studs 46 through 49 extending upwardly through openings 74 through 77 in mounting plate 72. The EMR tool 36 is attached to the upper surface of mounting plate 72, such as by recessed bolts (not shown) or other means. The EMR tool 36 is thus precisely located relative to base plate 42 and the positioning member or other apparatus to which base plate 42 may be secured or part of.

Die coil springs 90 through 93 are fitted over the extending portions of studs 46 through 49 and are preloaded (compressed) to a selected amount (approximately 150 pounds in the embodiment shown) by washer and nut combinations 96 through 99. While variable force coil springs are disclosed, it should be understood that other resilient elements or mechanisms, such as bellville washer springs, fluid pressure elements or even magnetic elements could be used. The amount of preload on the springs is selected such that mounting plate 72 and hence EMR tool 36 stays precisely engaged with base plate member 42 under normal operation of the riveting head.

The rear stop 64, with its lipped configuration, against which rear edge 89 of mounting plate 72 is positioned, desensitizes the apparatus significantly in the forward/rear axial direction (force exerted in that direction by a contact) to accommodate axial clamp-up forces and the axial recoil load of the EMR tool 36. A greater contact force in the forward/near direction is thus necessary to cause the mounting plate to move relative to the base plate. Typically, such force will lift the mounting plate and EMR tool off the base member. Hence, it should be understood that the apparatus (specifically the raised portion) can be configured so that the base assembly system has different force sensitivities in different axes. For instance, in the embodiment shown, as noted above, the coil springs provide approximately 150 pounds of preload at each corner of the base assembly. This readily accommodates a typical clamp-up load on the EMR pressure feet at the front end of the EMR tool 36 of approximately 800 pounds, and a recoil of approximately 200 pounds maximum, i.e. a total maximum load in normal operation of 1000 pounds. The center of EMR tool 36 is approximately 3.25" above base plate member 42, such that the amount of torque which would tend to overturn the device is 3250 inch pounds. The coil springs are on 14" centers and hold the EMR tool 36 down relative to the back stop with 4200 inch pounds. Hence, the preload force exerted by the springs exceeds the maximum overturn torque in normal operation of the riveting apparatus.

Extending from cutout portions 100 and 102 in each of the side edges 101, 103 of mounting plate 72 are trip switches 104 through 107, i.e. there are two trip switches in each cutout portion 100, 102. The trip switch actuators fit into mating sockets in the cutout portions. The trip switches 104 through 107 are arranged such that a movement of the mounting plate 72 relative to base plate 42, such as might be caused by a contact between the riveting head assembly and the part assembly, will result in an action of the trip switch. An indication thereof is transmitted to the control system for the riveting apparatus as well as to the operator's display, shown representationally in FIG. 4 at 109 and 111.

In operation, a contact between the EMR tool and the part assembly (such as the J stringer) will result in some force exerted on the EMR tool which as indicated above is securely mounted to mounting plate 72. In the embodiment shown, a side load of 300 pounds will be sufficient to overcome the spring resistance of springs 46–49 and cause mounting plate 72 to slide up the raised portion on the base plate. The beveled side surfaces of the raised portion facilitates this movement without any damage to the raised portion or the mating recess in the mounting plate. This repositioning action of the mounting plate 72 relative to the base plate member 42 causes one or more of switches 104, 107 to activate. The resulting signal sent to the control section 109 will result in an immediate stop of the EMR tool. The apparatus thus in effect automatically "shuts down." This saves the EMR tool and the part assembly from damage.

The operator is notified of the contact by a message on a computer screen 111 as well as an audible alarm, if desired. The operator then will typically have the opportunity to review the contact on a monitor, via a video tape of the event. The operator then will in effect re-activate the riveting apparatus via the control panel for the apparatus and then will move the riveting head away from the contact condition by a series of small step movements. Once the EMR tool in FIG. 4 has been moved away from the contact with the part, the mounting plate 72 and hence the EMR is quickly and automatically pulled back into exact alignment with the base plate by the action of springs 90–93 in combination with the beveled shape of the raised portion. Riveting operations can then proceed. This is a substantial advantage over existing systems. There is no need for the operator to re-attach any parts or even leave the operator's console, and there typically will be no resulting damage from a contact, thus saving a substantial amount of time and expense in riveting operations.

While side loads of 300 pounds are sufficient to move the mounting plate from the base member, approximately 1500 pounds are necessary in the forward/rear axial direction in the arrangement shown. due to the effect of rear stop 64. These amounts may of course be varied by appropriate design of the apparatus, depending upon the particular application.

In one configuration of the EMR tool, the pressure feet are mounted from the front of the EMR tool. In this configuration, the contact base assembly disclosed above provides contact protection for both the ram portion of the EMR and the pressure feet. In other EMR arrangements, however, the contact base assembly may provide contact protection for just the pressure foot assembly or just the ram, since the pressure foot may be mounted separately.

The above described arrangement is particularly convenient on the rear side of the part assembly in which there is no drill arrangement. On the drill side, the pressure foot is not mounted on the EMR, since the ram must be moved out of the way to permit access to the part assembly by the drill while the pressure foot must remain in position to provide clamp-up pressure.

Figure 8:
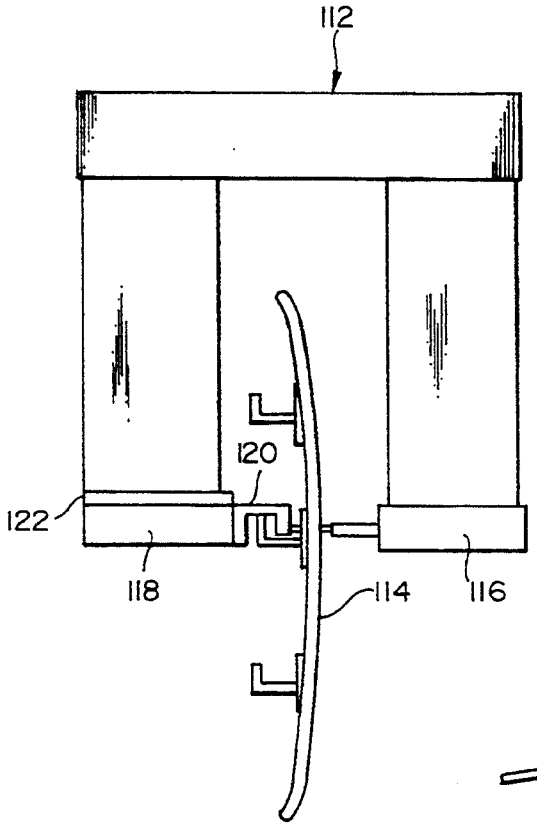
FIG. 8 shows an arrangement of the apparatus of FIG. 1 with a "C" yoke assembly using electromagnetic riveting head assemblies.

FIG. 8 shows a configuration involving a "C" yoke arrangement 112 and a wing panel/stringer part assembly 114. The riveting apparatus includes a drill side EMR 116 and a backup side EMR 118 with an angled portion 120 which extends around the "J" stringer portion of the part assembly 114. In this arrangement, the contact base assembly 122 of the present invention is used on just the stringer side, i.e. the backup side, EMR only.

FIG. 8 is shown with EMR type riveters. However, if FIG. 8 included a conventional hydraulic ram arrangement, the total pressure of 6,000 to 50,000 pounds for the upset of a rivet would be transferred through the spring base assembly. In that circumstance, there is protection for side load contacts only. The arrangement of FIG. 9, involving a "J" stringer part assembly 126 and a configured ram 128 includes a mounting plate 130 held by springs 132—132 to a base assembly 134. Typically, the raised portions mating the mounting plate to a base member in such an arrangement will be at a 90° angle, like a key, so that the contact causes a "lift off" type of movement. Trip switches 136—136 are actuated in response to such a sideload contact, which results in stoppage of the riveting apparatus.

Figure 5:
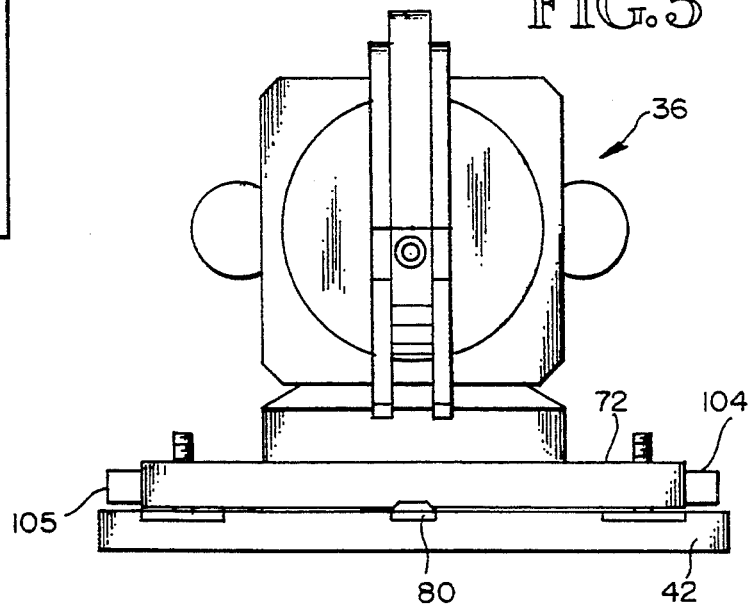
FIGS. 5 and 5A are front elevational views showing typical operation of the structure of FIG. 4.
Figure 5A:
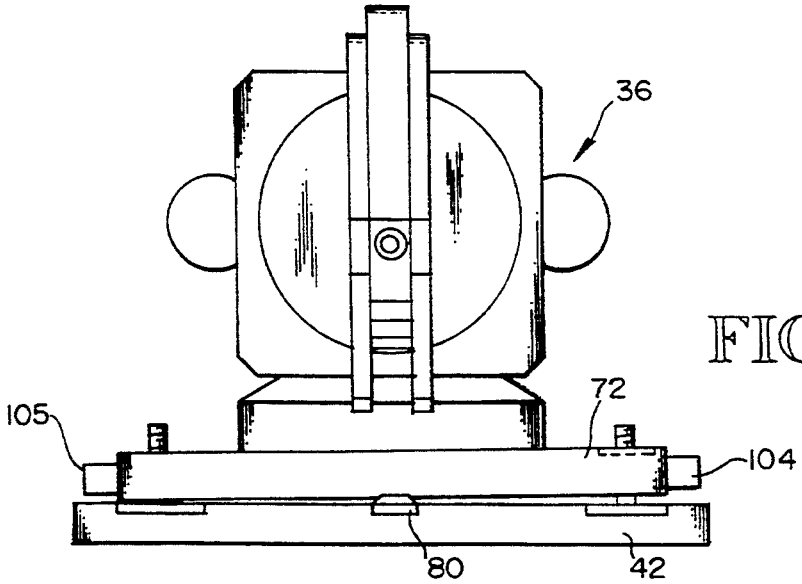

FIGS. 5, 5A, 6, 6A and 7, 7A show the action of various elements of the apparatus of FIG. 4 during both normal and contact conditions. FIG. 5 shows the riveting apparatus of FIG. 4 and the relationship between the mounting plate 72 and the base assembly from a front elevational view. In FIG. 5A, a 0.5° counter clockwise rotation of the mounting plate and EMR, produced by a contact between the EMR and the part assembly produces a slight lifting of the right side of the mounting plate 72 relative to the base member 42. This sensitivity is made possible by the beveled raised portion/recess arrangement described above. This arrangement provides accurate positioning between the two elements, but permits movement between the two elements without damage thereto by an initial contact sufficient to trip the sensing switches but without damage to the part assembly or the EMR tool.

Figure 6A:
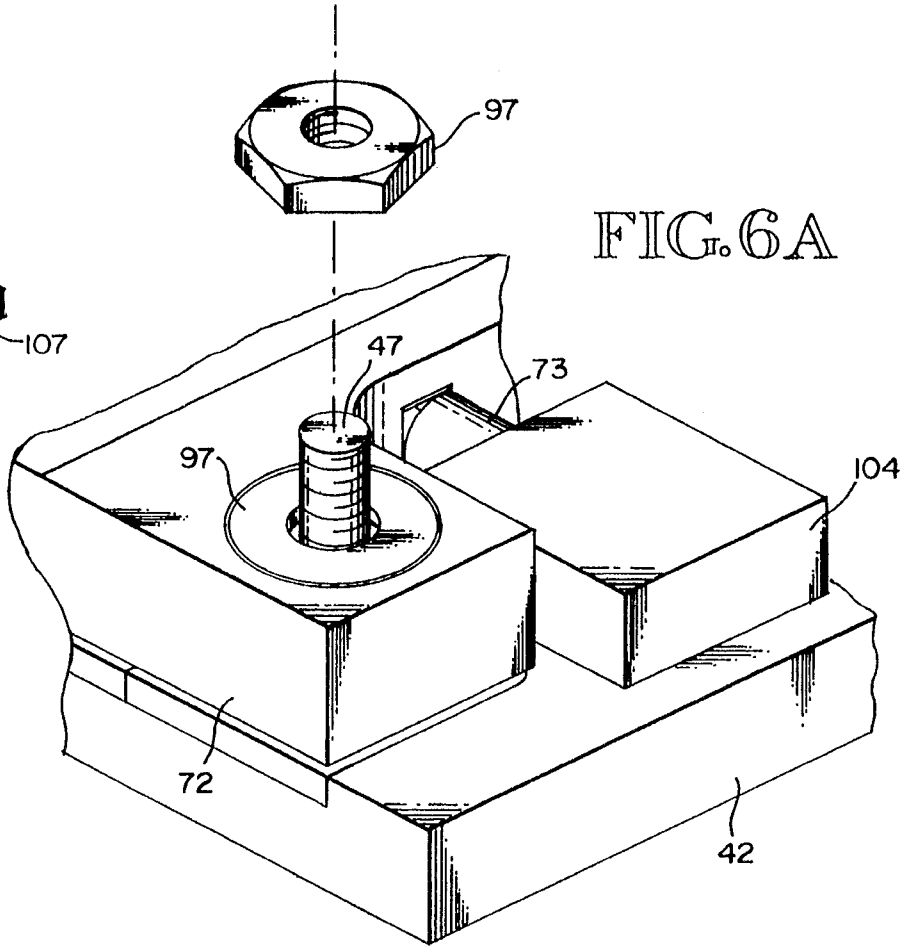
FIGS. 6 and 6A, and 7 and 7A are perspective views showing the operation of the apparatus of FIG. 4.
Figure 6:
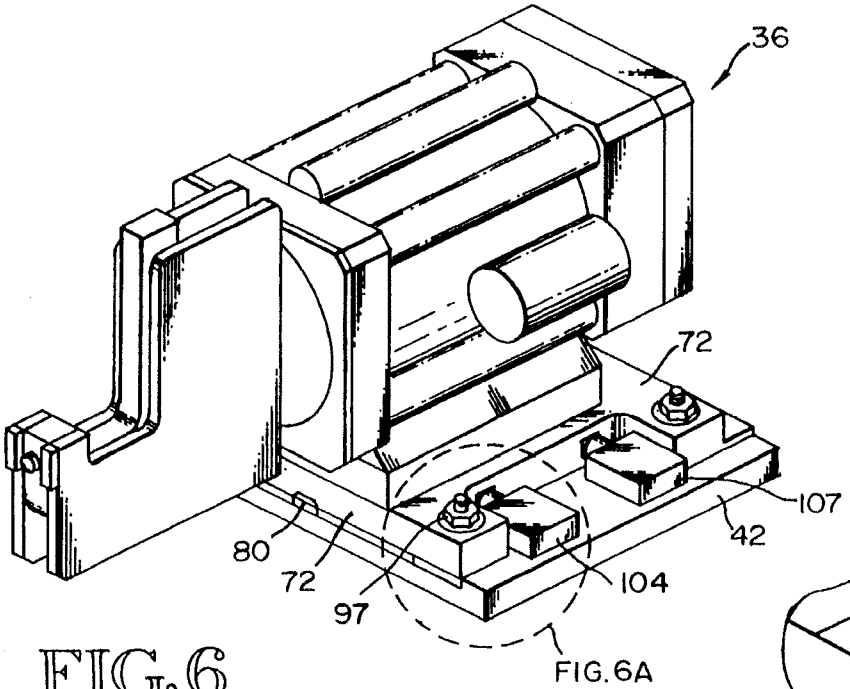
Figure 7A:
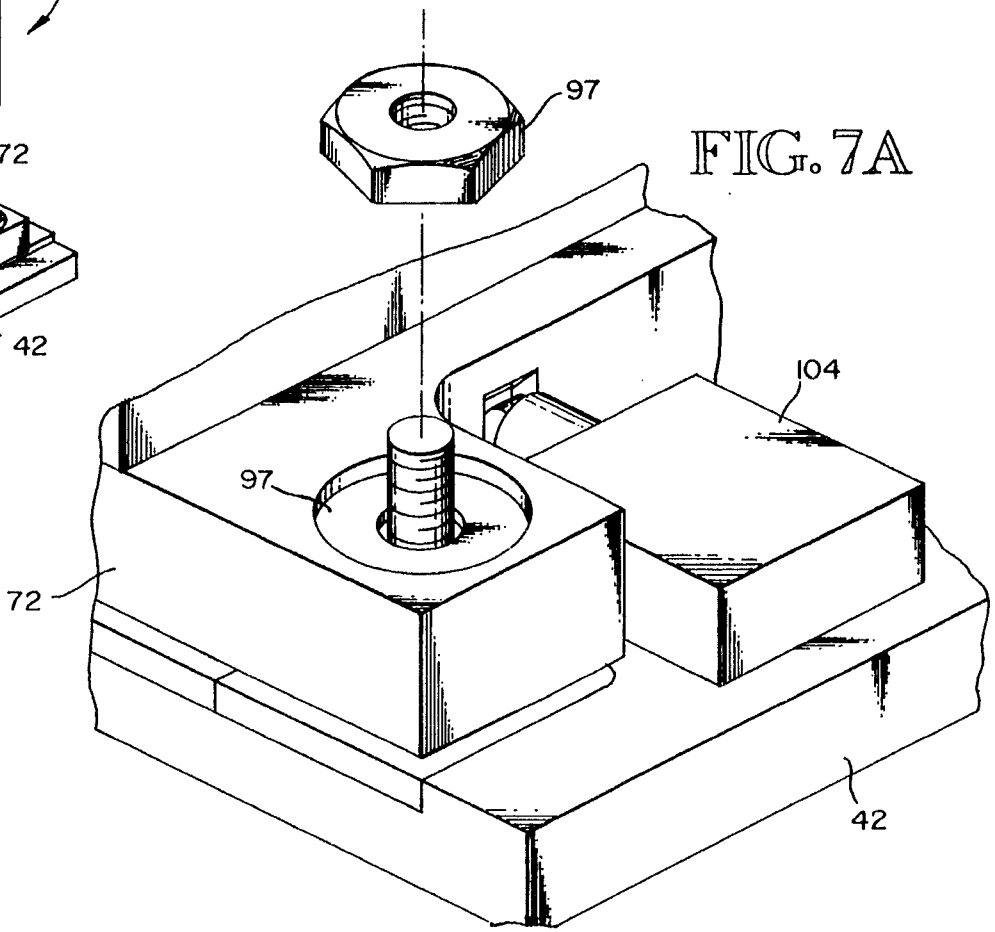
Figure 7:
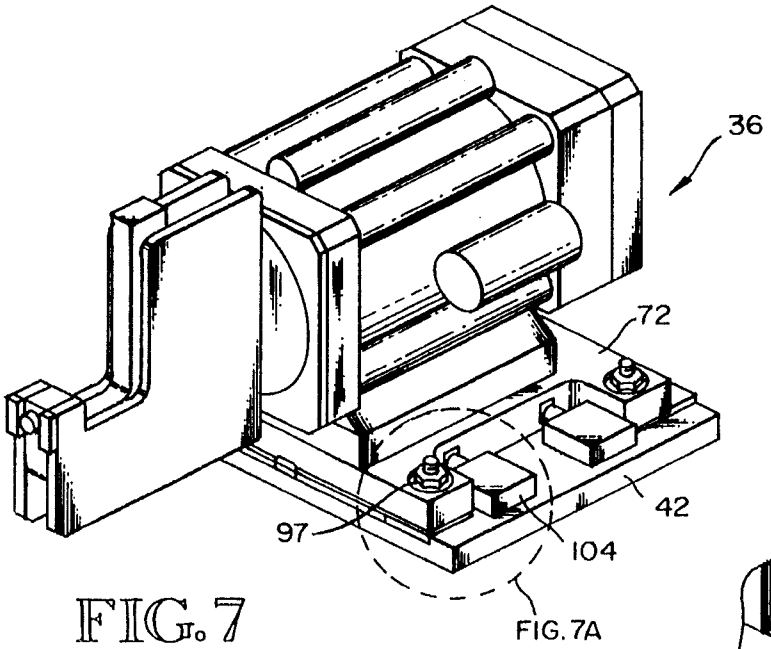

FIGS. 6 and 6A show the coil spring/nut washer arrangement at the forward right corner of the base assembly in normal position (as well as trip switch 104). FIG. 7 and 7A show mounting plate 72 being elevated somewhat, as shown by the depressed position of the washer, and the resulting tripped condition of the trip switch activator 73. As FIGS. 5A–7A show, just a beginning of contact, resulting in slight movement of the mounting plate, is sufficient to produce a trip, stopping operation of the riveting apparatus.

Figure 11:
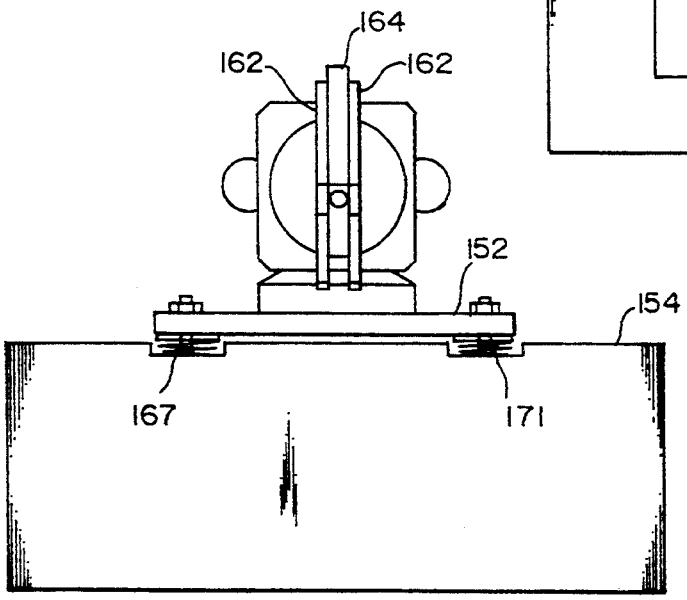
FIG. 11 is an elevational view of the apparatus of FIG. 10.
Figure 10:
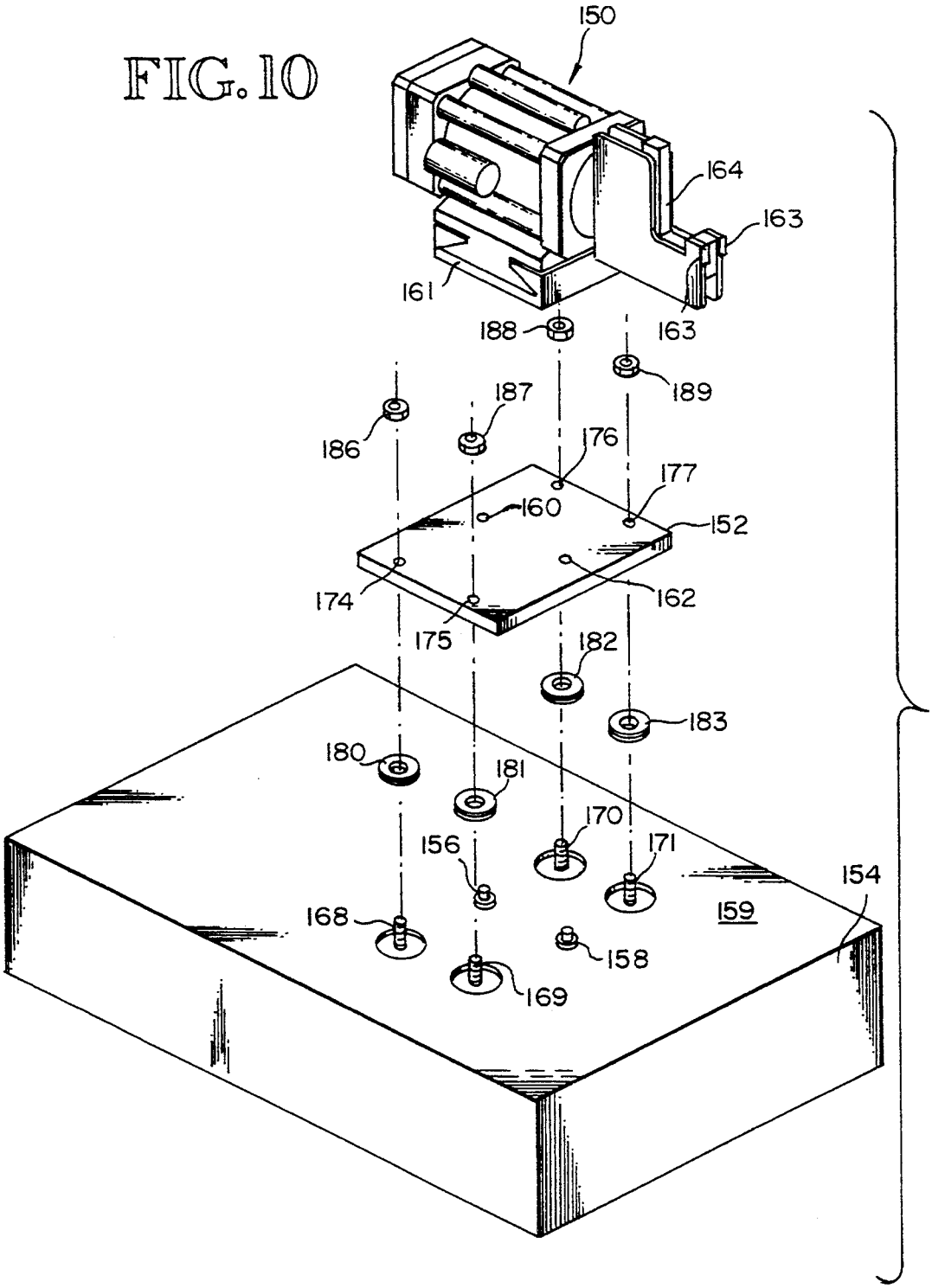
FIG. 10 is an exploded perspective view showing a system useful for height adjustment of a riveting head assembly.

FIGS. 10 and 11 show the height adjustment base assembly system of the present invention. An EMR riveting apparatus is shown at 150. The riveting apparatus 150 is mounted on a mounting plate 152. Mounting plate 152 is in turn secured to a tooling table/positioner apparatus or other surface element 154. which may be moved by motors and the like in normal riveting operations. Mounting plate 152 is mounted on two locating pins 156 and 158, which extend upwardly from the upper surface 159 of tooling table 154. The locating pins 156, 158 extend through two precision bushings 160 and 162 in the mounting plate, thereby providing a very accurate positioning of mounting plate 152 relative to tooling table 154. Mounting plate 152 is, however, free to move vertically on the locating pins in order to produce a height adjustment of the EMR tool. Alternatively, one or more keyed slots could be used to provide a precise positioning of the mounting plate on the table 154.

Extending upwardly from the upper surface 159 of tooling table 154 are four spaced mounting studs 168 through 171. Mounting studs 168–171 extend through four openings 174–177 in mounting plate 152. Compressible spring washers 180 through 183 are positioned between mounting plate 152 and tooling table 154. Locking nuts, such as Nylock nuts, 186 through 189 are mounted on the mounting studs to secure mounting plate 152 and hence the EMR tool to the tooling table 154. The Nylock nuts typically are tightened sufficiently to preload the washers enough that in operation of the riveting apparatus, the load transferred to the base assembly shown in FIG. 10 by virtue of riveting operations will be less than the preload on the spring washers. Hence, normal operation of the riveter will not result in any deflection of the EMR tool 150 due to further compression of the spring washers. Typically, over and above the preload compression, vertical travel capability for the washers over a range of ±0.025" remains, which is typically sufficient for any height adjustment necessary. The range could be more or less, however, depending upon the application.

The EMR tool 150 is conveniently alignable in the longitudinal direction by means of a conventional dovetail slot 160. The above-described arrangement permits convenient height adjustment. The actual height adjustment in one direction or the other is accomplished by simply tightening or loosening the Nylock nuts 186 through 189.

While the present invention is useful for hydraulic, pneumatic and EMR riveters, it is most useful with the later 2 types of riveter, because of the relatively low forces which are transmitted through the base assemblies of such riveters. In the embodiment of FIGS. 10 and 11, the EMR tool 150 has both a pressure foot 162 and a ram 164. The force transmitted by the EMR 150 back to the base positioning system is the sum of the clamp-up load and the recoil load, which typically will total 1000 pounds. If the center of the EMR riveter is 3.25" above the mounting base, the overturn is thus 3250 inch pounds. Each spring washer will have a preload of approximately 1000 pounds such that the righting moment from the springs is approximately 24,000 inch pounds. The actual overturn force is thus only a small percentage of the preload and hence, there should not be any movement of the base assembly during actual operation of the EMR.

One advantage of the height adjustment system of the present invention is that it is convenient to adjust the height during actual operation of the EMR. Hence, EMR height position can be "fine tuned" by observing the rivets being formed during operation of the apparatus along a line of rivets on a part assembly. Another advantage of the height adjustment arrangement of the present invention is that it is compact and very low profile. Referring to FIG. 11, it can be seen that when spring elements 169 and 171 are completely compressed, the mounting member 152 is positioned right against the upper surface of positioning table (surface element) 154. In this configuration, the EMR is at a "zero" height.

It should also be understood that the height adjustment assembly of the present invention and the contact assembly of the present invention can both be accommodated in a single base system, i.e. the mounting plate 72 in FIG. 4 can be the mounting plate 152 of FIG. 10. The springs 90–93 in the embodiment of FIGS. 1 through 9 would in that case be positioned in the upper surface of the mounting plate while the height adjustment spring washers are positioned beneath the mounting plate, between the mounting plate and the base plate element 42, which can be secured to or part of the apparatus positioning system.

Hence, a base assembly for a riveting apparatus has been disclosed. In one aspect, the assembly is arranged to prevent damage to part assemblies being riveted caused by an inadvertent contact between the riveting apparatus and the part assembly. This is accomplished by quickly and automatically recognizing a contact by virtue of the resulting permitted movement of the mounting plate relative to the base plate and then stopping further operation of the apparatus. In another aspect, a convenient height adjustment mechanism is provided via preloaded spring washers so that the EMR apparatus can be accurately and quickly positioned heightwise relative to the line of rivets, even during actual operation of the apparatus.

Although a preferred embodiment of the invention has been disclosed for purposes of illustration it should be understood that various changes, modifications and substitutions may be made without departing from the spirit of the invention which is defined by the claims which follow. For instance, it should be understood that while the invention is disclosed in the context of a riveting apparatus for large scale aircraft assembly operations, it is not limited to such assembly operations, and furthermore may be useful with other high force assembly devices.

What is claimed is:

1. A base assembly for use with a tool apparatus which performs high force operations at multiple locations along a part assembly, the base assembly comprising:

a base member, the base member having a first mating surface portion;

a mounting member having a second mating surface portion which mates with the first mating surface portion of the base member, wherein the mounting member includes means for mounting the tool apparatus thereon, so that the tool apparatus is precisely located relative to the base member;

resilient member means holding the mounting member to the base member; and sensor means positioned such that when contact occurs between the tool apparatus and an object during movement of the tool apparatus along the part assembly, which results in a change in the position of the mounting member relative to the base member, the sensor means produces an indication thereof.

2. The base assembly of claim 1, wherein the first and second mating surfaces include, respectively, complementary beveled portions.

3. The base assembly of claim 2, wherein the first mating surface is a raised portion on an upper surface of the base member and the second mating surface is a recessed portion in the lower surface of the mounting member.

4. The base assembly of claim 2, wherein the beveled portions have different bevel angles in different sections thereof so that the amount of contact force necessary to produce a position change will vary depending upon the direction of the contact force on the base member.

5. The base assembly of claim 1, wherein the resilient member means include spring members located approximately at four corners of the mounting member, the spring members being mounted about stud elements which extend between the mounting member and the base member, the resilient member means further including locking members cooperating with the stud elements to maintain the spring members in preload compression and hence, to maintain the mounting member in accurate position against the base member.

6. The base assembly of claim 1, wherein the resilient member means includes means for maintaining the resilient member means in a selected preload compression sufficient to exceed the force produced by normal operation of the tool apparatus.

7. The base assembly of claim 1, wherein the tool apparatus is a riveting machine.

8. The base assembly of claim 1, wherein the sensor means is a trip switch, wherein said indication is an electrical output signal, wherein the apparatus includes means for transmitting said electrical output signal to a control means for the tool apparatus, and wherein the base assembly includes means for temporarily stopping movement of the tool apparatus in response to said electrical output.

9. The base assembly of claim 1, including a stop element positioned along a selected edge of the base member, against a front edge surface of said stop element a selected edge of the mounting member abuts, the front edge surface of the stop element preventing a change in position of the mounting member relative to the base member in an axial direction perpendicular to the selected edges of the stop element and the base member until the force produced on the tool apparatus in said axial direction exceeds a selected amount.

10. The base assembly of claim 1, wherein the resilient member means is sufficiently resilient that upon release of contact between the tool apparatus and the object, the mounting member will automatically return to its original precise location relative to said base member.

11. The base assembly of claim 1, wherein the sensor means includes trip switches mounted along side edges of the mounting member, wherein the trip switches include an actuating member in contact with the mounting member for recognizing said change in position of the mounting member relative to said base member.

* * * * *